US006311743B1

(12) United States Patent
Baroncini

(10) Patent No.: US 6,311,743 B1
(45) Date of Patent: Nov. 6, 2001

(54) DEVICE FOR FEEDING TABLETS AND THE LIKE TO A PACKAGING MACHINE

(75) Inventor: Ivano Baroncini, Osteria Grande (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 0 days.

(21) Appl. No.: 09/658,076

(22) Filed: Sep. 11, 2000

(30) Foreign Application Priority Data

Sep. 21, 1999 (IT) ..... B099A0504

(51) Int. Cl.[7] ..... B65B 1/04; B65B 3/04; B65B 37/00; B67C 3/00

(52) U.S. Cl. ..... 141/234; 141/18; 141/83; 141/131; 141/145; 141/237; 141/238; 141/239; 141/240; 209/920; 53/52; 53/246; 53/505

(58) Field of Search ..... 141/18, 83, 94, 141/129, 131, 144, 145, 234, 237–240; 209/920; 53/52, 246, 505

(56) References Cited

U.S. PATENT DOCUMENTS 4,750,318 * 6/1988 Matsuzawa ..... 53/559
5,522,512 * 6/1996 Archer et al. ..... 209/580
5,802,804 * 9/1998 Esposti et al. ..... 53/55

* cited by examiner

*Primary Examiner*—Timothy L. Maust
(74) *Attorney, Agent, or Firm*—William J. Sapone; Coleman Sudol Sapone P.C.

(57) ABSTRACT

A device for feeding tablets in a blister packaging machine includes a vibrating container containing a mass of tablets. The vibrating container features a bottom wall, one portion of which includes tablet feeding channels, communicating with related slots made in the bottom wall. The slots communicate with the conveying means, which feed the tablets along a predetermined feeding path and release the tablets into respective blisters of a blister band. The blister band moves in a determined direction inside the packaging machine. The conveying means include a plate with a plurality of grooves, arranged one beside another and a covering element. The covering element is coupled with said plate, so as to move with respect thereto and includes transversal wings, each of which is situated inside a respective groove of the plate, so as to define a respective channel for conveying said tablets. At least one covering element is coupled with actuators which drive the covering element to oscillate alternately with respect to the plate, so as to facilitate the tablets movement along the conveying channels.

6 Claims, 5 Drawing Sheets

DEVICE FOR FEEDING TABLETS AND THE LIKE TO A PACKAGING MACHINE

FIELD OF THE INVENTION

The present invention relates to a device for feeding tablets and the like to a packaging machine.

The present invention is advantageously used, preferably in pharmaceutical field, for feeding and placing tablets or pills into respective blisters made in a blister band fed to a blister packaging machine. The following description will refer to this blister packaging machine, however the invention can be exploited in more general way.

DESCRIPTION OF THE PRIOR ART

Disc-like or oblong tablets or pills are fed to a packaging machine by a feeding device usually including a rotating container or a basin, which contains a mass of tablets moving in a circular direction, substantially continuous.

A part of a horizontal flat bottom wall constituting the rotating basin bottom, features semi-circular ribs, which define channels for feeding and orienting the tablets.

Each of the channels opens in the region of a relative slot made in the bottom wall and communicates with an upper end of a corresponding vertical tubular duct, through which the tablets go downwards.

The lower end of the vertical tubular duct is situated over the blister band, that is made of heat-formable material and moves inside the blister packaging machine.

Therefore, along the tubular channels, groups of tablets are formed which go down one after another toward respective blisters of the blister band, so as to fill the blisters.

During normal operation of the packaging machine, the tubular channels get frequently jammed by tablets which close the channels. This results in the stop of the tablets downward movement.

In particular, the tubular channel can often get obstructed during feeding tablets of rounded shape and/or with smoothed edges, because with this type of tablets, it is frequent that one tablet slides down immediately after the previous one, placing itself partially over the previous one and causing the obstruction of the tubular channel.

SUMMARY OF THE INVENTION

The object of the present invention is to propose a device for feeding tablets, which avoids the above mentioned problem.

A device for feeding tablets and the like in a packaging machine, obtained according to a present invention includes a rotating container, which contains a mass of tablets and features a bottom wall, a part of which is equipped with tablets feeding channels communicating with relative slots made in said bottom wall; and conveying means for conveying said tablets along a predetermined feeding path and releasing the tablets into respective blisters of a blister band, which moves inside the packaging machine, said conveying means communicating with said slots; the device being characterized in that said conveying means include a plate equipped with at least two grooves, arranged one beside the other and defining respective conveying channels for said tablets and a covering element, coupled with said plate, so as to move with respect to said plate; actuator means connected at least to said covering element, so as to drive the covering element to oscillate with respect to the plate, in order to facilitate the transport of the tablets along the conveying channels.

The conveying channels are preferably vertical and define a vertical direction for the tablets along a straight portion of the path.

The covering element is driven to move alternatively due to the push of actuator means in a direction parallel to the tablets feeding direction.

BRIEF DESCRIPTION OF THE DRAWINGS

The present invention is described with reference to the enclosed drawings illustrating two non limitative embodiments, in which.

DESCRIPTION OF THE PREFERRED EMBODIMENTS

Figure 1:
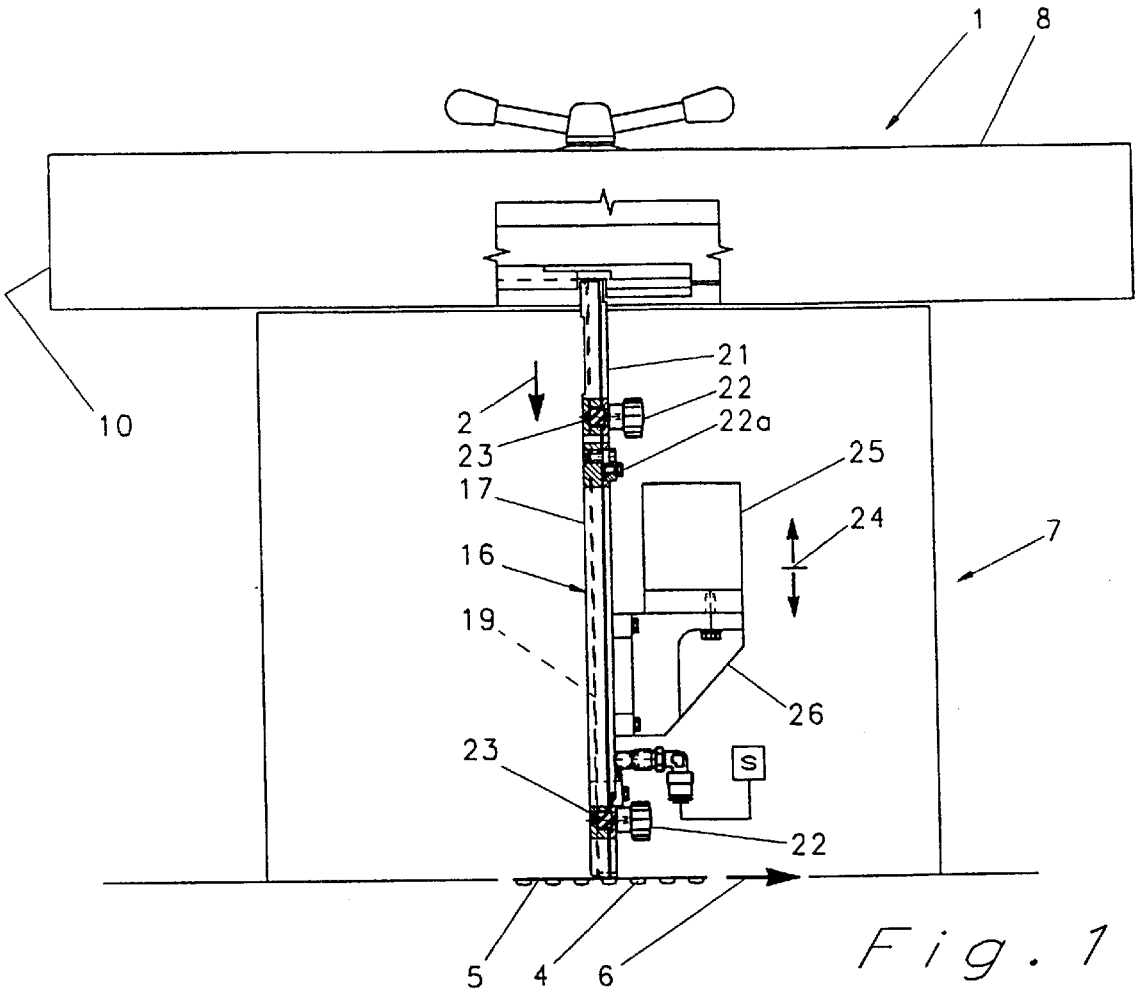
FIG. 1 is a schematic front view, partially in section and with some parts removed for clearness, of a preferred embodiment of the proposed device for feeding tablets.
Figure 2:
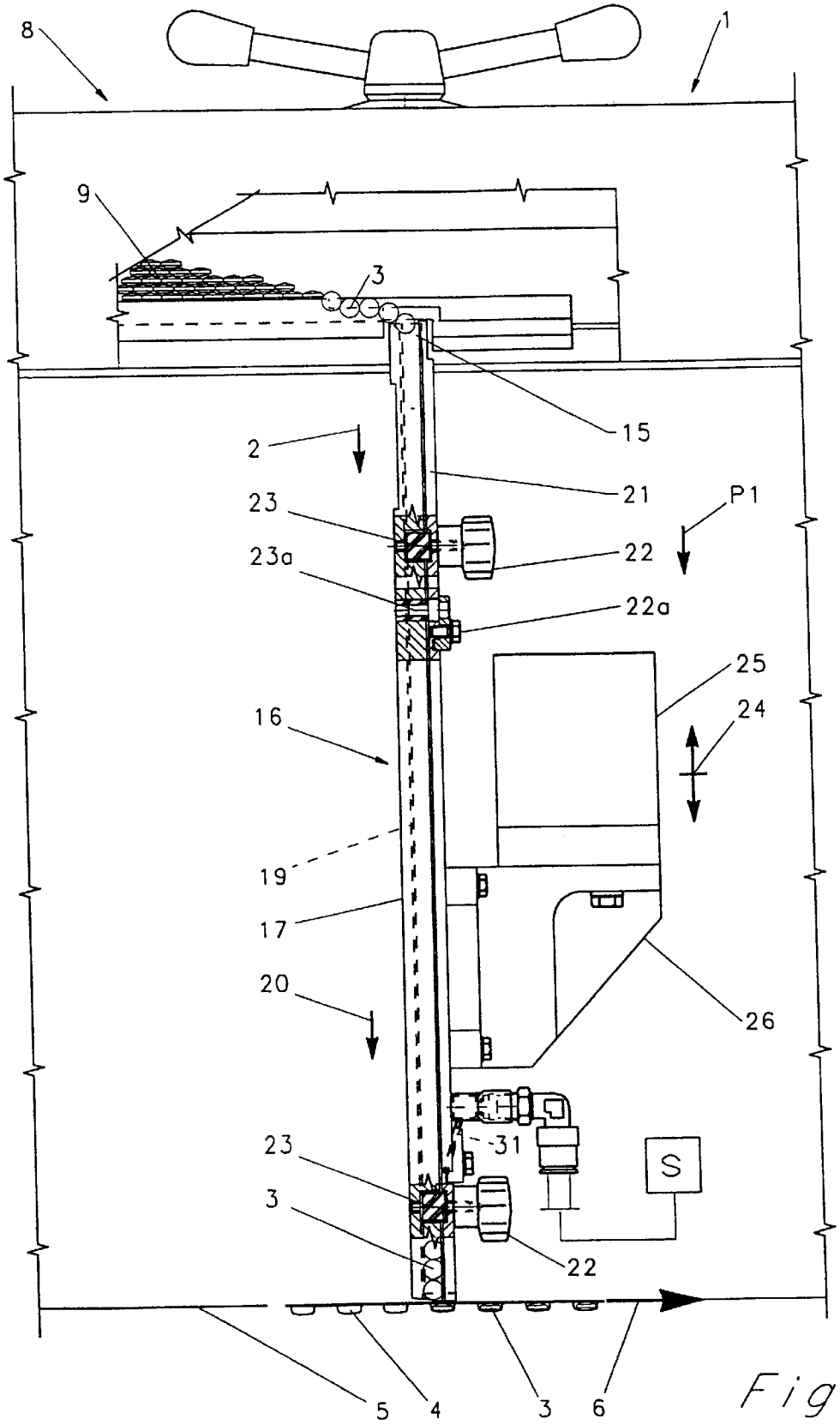
FIG. 2 is an enlarged view, with some parts in section and with some parts removed for clearness, of the device of FIG. 1.
Figure 3:
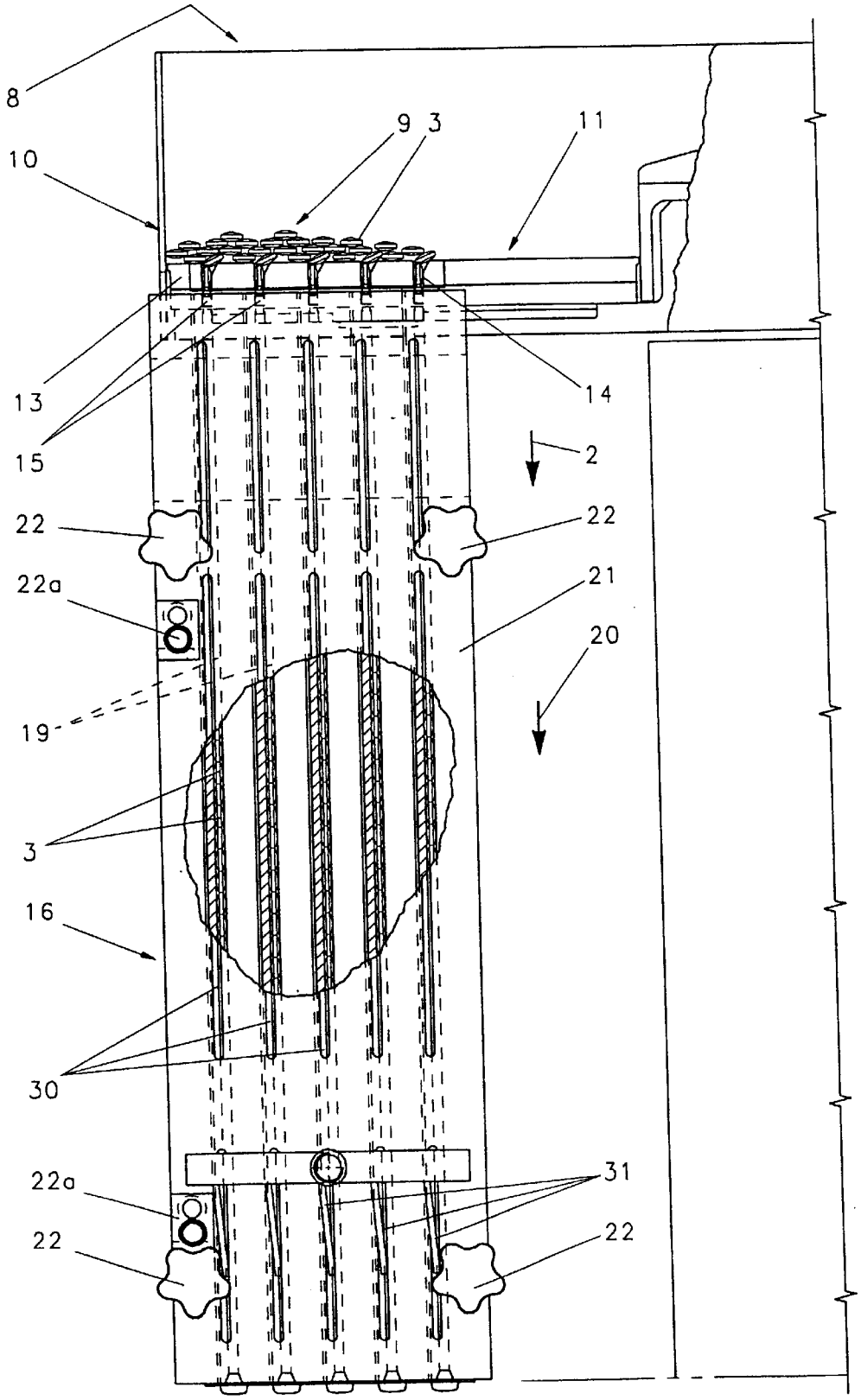
FIG. 3 is a lateral schematic view of the device of FIG. 1.

With reference to FIGS. 1, 2 and 3, reference numeral 1 indicates a device for feeding tablets 3, preferably pharmaceuticals, along a path 2, and subsequently for releasing the tablets 3 into respective blisters 4 made in a blister band 5. The band 5 moves in a direction 6 inside a packaging machine 7. The device 1 is an integral part of the packaging machine 7.

The device 1 includes a container or circular basin 8, driven to vibrate in a known way by actuator means, also known and not shown. The basin 8 is aimed at containing a mass 9 of tablets 3 moving in a substantially continuous circular flow.

Figure 5:
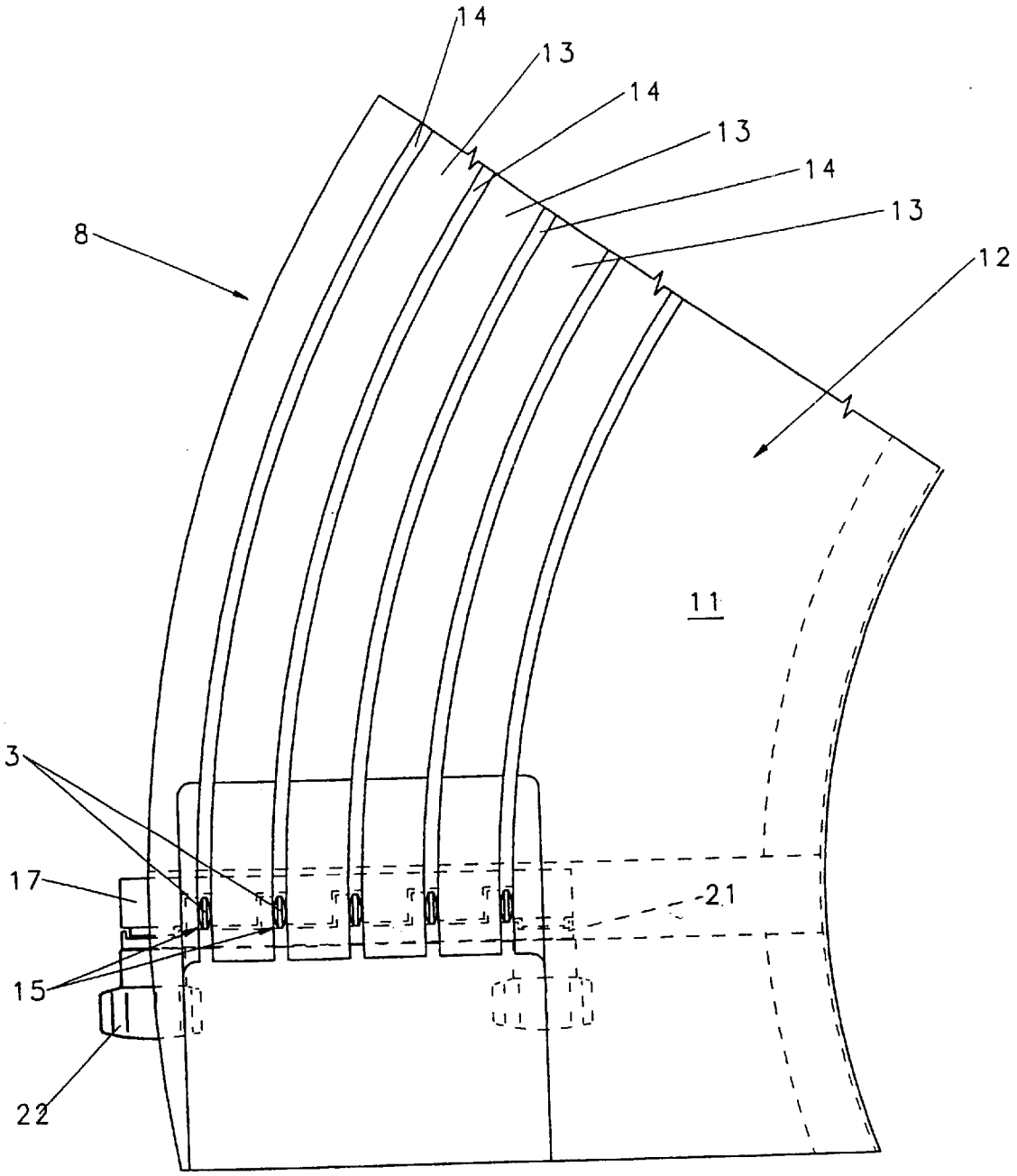
FIG. 5 is a plan view of another particular of FIG. 3.

As seen in FIGS. 1, 3 and 5, the vibrating basin 8 has a lateral wall 10 and a horizontal bottom wall 11.

A part 12 of the bottom wall 11 features a plurality of semi-circular ribs or guides 13.

The guides 13 define, on the bottom wall 11 of the basin 8, respective channels 14 for feeding and orienting tablets 3.

Each of the channels 14 opens in the region of a related slot 15 made in the bottom wall 11.

As seen in FIGS. from 2 to 5, the slots 15 communicate with tablets conveying means 16, which include a plate 17, with a plurality of vertical grooves 18 made therein.

The transversal dimension, or width L of each of the grooves 18, preferably of square (FIG. 4) or semi-circular (not shown) cross section, is substantially equal to a double value H, which corresponds to the thickness of a tablet 3.

The grooves 18 are arranged one beside another and define respective vertical channels 19, which convey the tablets 3 one after another or in continues columns in a vertical feeding direction 20.

The conveying means 16 include also a cover 21, coupled with the plate 17 with possibility to move elastically with respect thereto, by fastening screws 22, which are equipped with elastic interposing means 23 of known type and by dap joint elements 22*a,* likewise equipped with elastic interposing means 23*a* of known type.

The cover 21 is driven, by an actuator 25, to oscillate alternately in a vertical direction 24, parallel to the feeding direction 20 along a straight portion P1 of the path 2, with respect to the plate 17.

The actuator 25 is fastened to a crosspiece 26, which is fastened to the cover 21, as better shown in FIG. 2.

Figure 4:
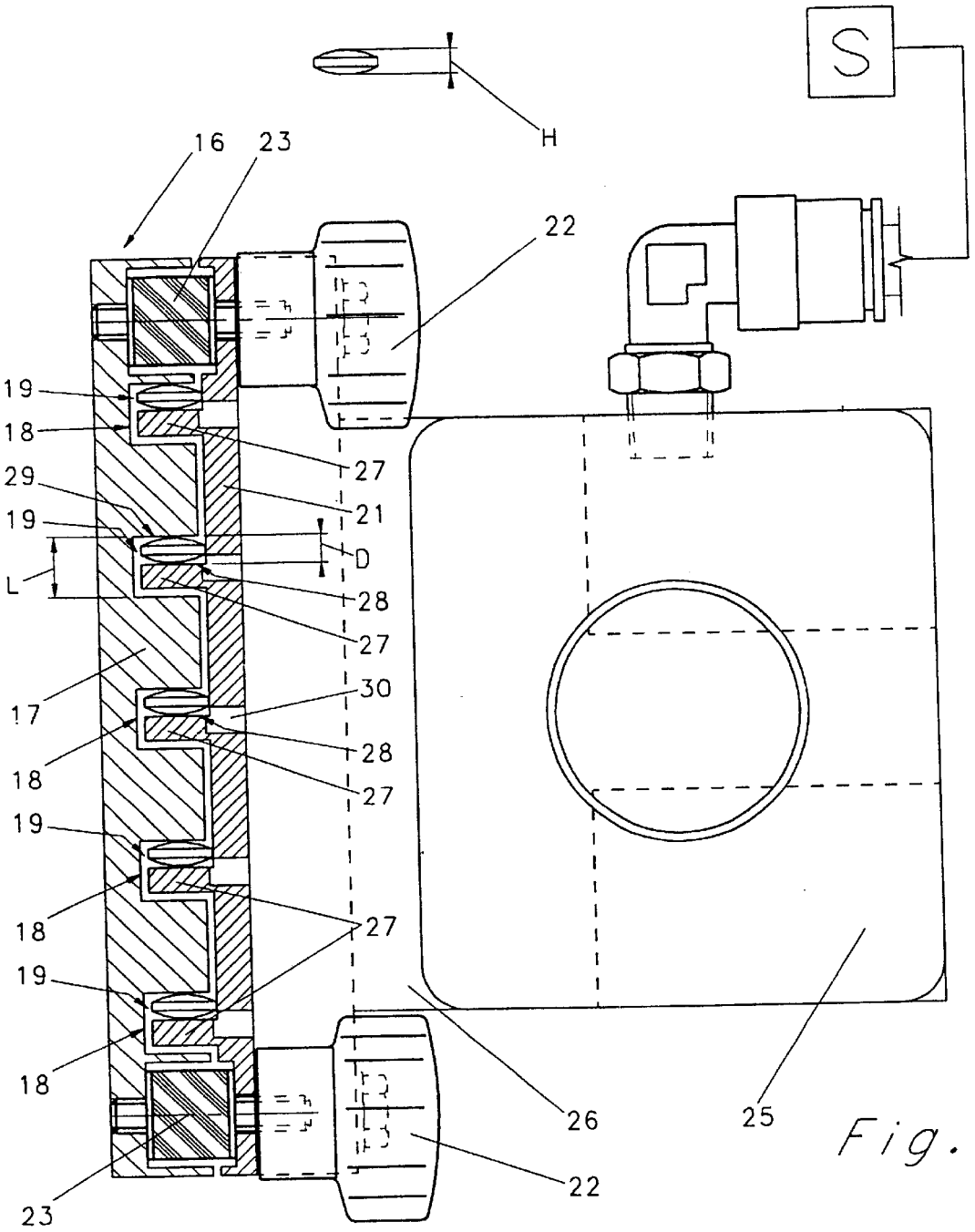
FIG. 4 is a plan, cross-section view of a particular of FIG. 3.

According to the preferred embodiment shown in FIGS. 2 and 4, the actuator 25 includes a pneumatic cylinder 25, communicating in known way with a source S of compressed air.

As better seen in FIG. 4, the cover 21 features transversal wings 27, which, when the cover 21 is coupled with the plate 17, are situated each one in a respective groove 18 of the plate 17, so as to define an oscillating lateral wall 28 of a channel 19 conveying the tablets 3.

In particular, the transversal dimension D or width of a channel 19, measured between the oscillating lateral wall 28 and an opposite lateral wall 29, is substantially equal to the thickness H of the tablet 3.

As seen in FIG. 3, the cover 21 features also a plurality or a matrix of inspection slots 30. During operation, the inspection slots 30 are aimed at inspecting visually the downward flow of the tablets 3 along the channels 19.

Moreover, the cover 21 is equipped with nozzles 31 communicating, in known way, with a source S of compressed air, which blows pressured air through the inspection slots 30 in a direction substantially parallel to the direction 24. The compressed air flow further facilitates the descent of the tablets 3 inside the channels 19.

Figure 6:
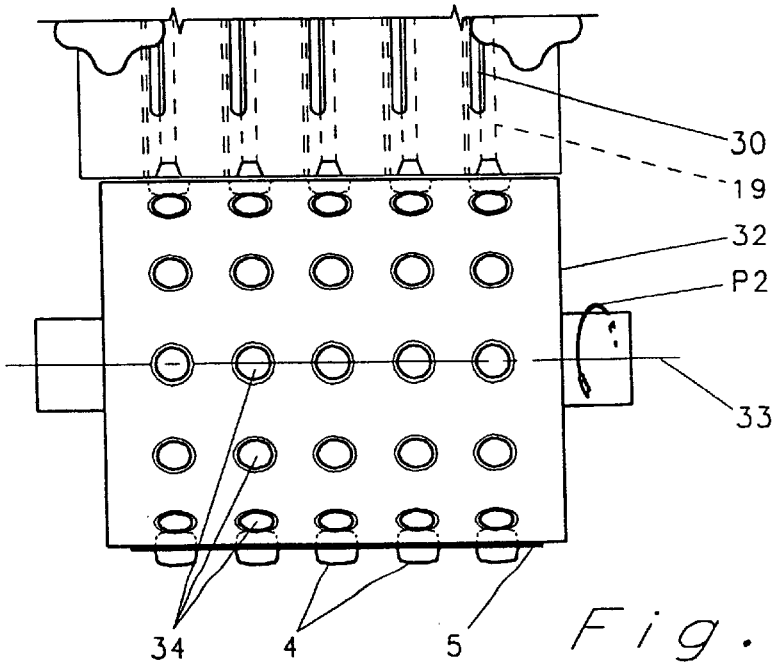
FIG. 6 is a lateral schematic view of a variant of the device of FIG. 1.

According to the version shown in FIG. 6, the conveying means 16 include also a conveying recessed roller 32, situated directly under the group defined by the plate 17 and the cover 21 coupled therewith, between this group and the band 5.

The conveying recessed roller 32 rotates about its axis 33, which is horizontal and crosswise to the direction 20 and the band 5.

Each of the recesses 34 of the roller 32 receives one of the tablets 3 leaving the channels 19 and feeds it to the band 5, along a curved portion P2 of the path 2, so as to release it, in known way, in step relation, into the respective blister 4 of the band 5.

During operation, the tablets 3 move along the channels 14 of the basin 8 and, after having reached the slots 15, fall into the respective vertical channels 19, in which continuous columns of tablets 3 are formed.

The tablets 3 move along the channels 19 and fall one after another into the blisters 4 of the blister band 5, or, according to the other version, into the recesses 34 of the roller 32, which subsequently release the tablets 3 to the blisters 4 of the blister band 5.

When the feeding device 1 is in operation, the actuator means 25, connected to the cover 21, push the wings 27 of the cover 21, so that they oscillate constantly inside the grooves 18 in direction 24 avoiding jams of tablets 3 due to their placing one over another.

Therefore, a correct downward movement of the tablets 3 along the channels 19 is facilitated, thus avoiding the possibility of obstruction of the channels 19.

What is claimed is:

1. A device for feeding tablets in a packaging machine, the device including:

a vibrating container having a bottom wall, said container filled with a mass of tablets, with a portion of said bottom wall featuring tablet feeding channels set in communication with related slots also made in said bottom wall;

conveying means for conveying said tablets along a predetermined feeding path and for releasing said tablets into respective blisters of a blister band moved inside the packaging machine, said conveying means communicating with said slots;

said device further including:

a plate forming said conveying means and featuring at least two side by side grooves defining respective channels for conveying said tablets;

a covering element coupled to said plate, said covering element being able to move with respect to said plate;

actuator means connected to at least said covering element, for driving said covering element to oscillate with respect to said plate.

2. A device as in claim 1, wherein said conveying channels are vertical and define a vertical direction of tablets feeding along a straight portion of said path; with said covering element driven by actuator means to reciprocate in a direction parallel to said vertical direction of tablets feeding.

3. A device as in claim 1, wherein said covering element includes transversal wings situated each one in a respective groove of said plate, so as to define a lateral oscillating wall of the related channel conveying the tablets.

4. A device as in claim 1, wherein said conveying means include a conveying recessed roller situated between said plate, and the coupled covering element, and said band; said conveying recessed roller rotating about an axis which is horizontal and crosswise to the vertical feeding direction and to said band, and with each recess receiving one of said tablets leaving said conveying channels and transferring feeding them to the band, along a curved portion of said path, so as to release, in step relation, said tablets into respective blisters of the band.

5. A device as in claim 1, wherein said covering element also includes a plurality, or a matrix, of inspection slots, which, during operation, allow visual inspection of the downward flow of said tablets along the conveying channels.

6. A device as in claim 5, wherein nozzles are provided, which communicate with a source of compressed air for blowing compressed air through said inspection slots in a direction substantially parallel to a vertical tablets feeding direction.

* * * * *